US005305556A

United States Patent [19]

Kopp et al.

[11] Patent Number: 5,305,556

[45] Date of Patent: Apr. 26, 1994

[54] METHOD AND APPARATUS FOR SHAPING THE INTERIOR SURFACES OF BORES

[75] Inventors: Oswald Kopp, Nurtingen; Gerhard Flores, Ostfildern, both of Fed. Rep. of Germany

[73] Assignee: Kopp Verfahrenstechnik GmbH, Leutkirch, Fed. Rep. of Germany

[21] Appl. No.: 882,566

[22] Filed: May 13, 1992

Related U.S. Application Data

[63] Continuation-in-part of Ser. No. 540,010, Jun. 19, 1990, abandoned.

[30] Foreign Application Priority Data

Jun. 19, 1989 [DE] Fed. Rep. of Germany ..... 3919895
Oct. 31, 1990 [WO] PCT Int'l Appl. ..... PCT/EP90/01822
Apr. 2, 1992 [DE] Fed. Rep. of Germany ..... 4210928

[51] Int. Cl.[5] ..... B24B 49/00

[52] U.S. Cl. ..... 51/165.77; 51/59 SS; 51/165.93

[58] Field of Search ..... 51/59 SS, 167.77, 165 R, 51/165.71, 165.76, 165.93

[56] References Cited

U.S. PATENT DOCUMENTS 2,445,934 7/1948 Bodine ..... 51/59 SS
2,460,919 2/1949 Bodine ..... 51/59 SS
2,818,686 1/1958 Weiss ..... 51/59 SS
2,939,250 6/1960 Kline ..... 51/59 SS
3,030,715 4/1962 Bodine ..... 51/59 SS
4,828,052 5/1989 Duran ..... 51/59 SS

FOREIGN PATENT DOCUMENTS 2435848 11/1978 Fed. Rep. of Germany .
3533082A1 3/1987 Fed. Rep. of Germany .
2-212069 8/1990 Japan .

OTHER PUBLICATIONS

Article "Werkstatt und Betrieb" 118 (1985)7, pp. 393-395.
Published Application No. 8814470.

*Primary Examiner*—M. Rachuba
*Attorney, Agent, or Firm*—Jones, Tullar & Cooper

[57] ABSTRACT

A method and apparatus for machining of bores in workpieces is described, where a honing tool, covered with an abrasive material coating and radially pressed against the wall of the bore, simultaneously performs a rotational motion and an axial reciprocal motion. In addition to the reciprocal and rotational motions, the honing tool performs a high-frequency, short-stroke self-oscillation, which is excited by ultrasonic oscillation in the range of 16 to 40 kHz.

11 Claims, 13 Drawing Sheets

Fig. 6
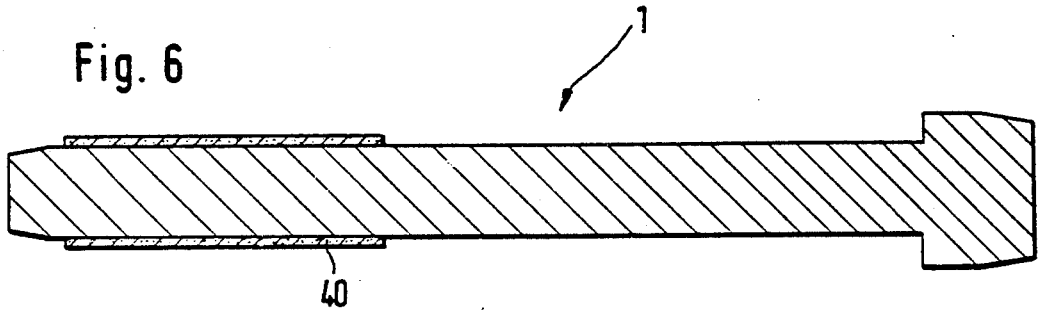
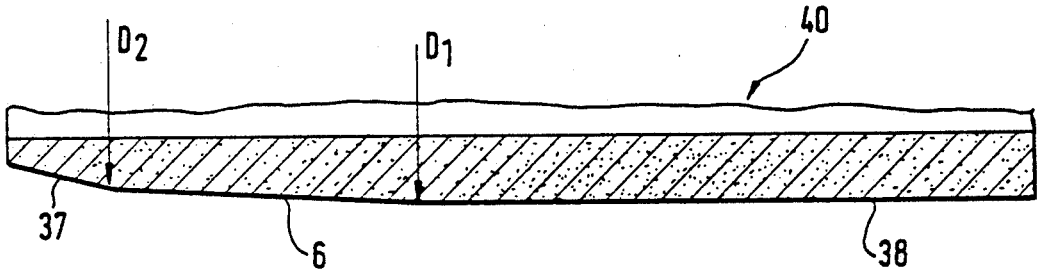
Fig. 7
Fig. 8
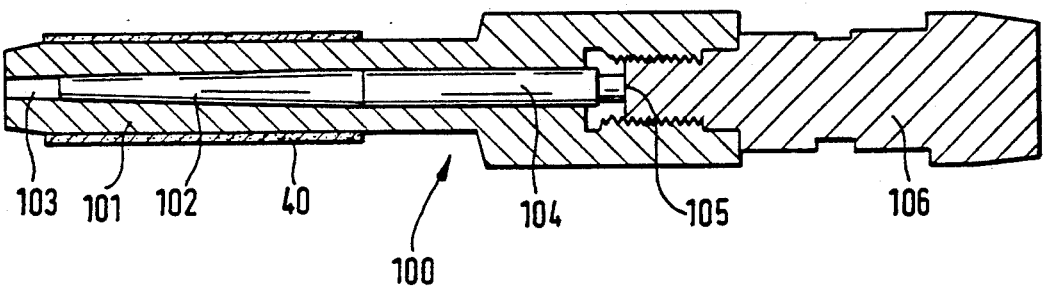

1
33
32
40
Dmax
Lmin
D0
L0
Dmin
Lmax
t
L

Dmax
Lmin
D0
L0
Dmin
Lmax

METHOD AND APPARATUS FOR SHAPING THE INTERIOR SURFACES OF BORES

CROSS REFERENCE TO RELATED APPLICATION

This application is a continuation-in-part application of application, Ser. No. 07/540,010, filed Jun. 19, 1990 now abandoned.

FIELD OF THE INVENTION

The invention relates to a method and apparatus for shaping the interior surface of bores in workpieces, where a tool provided with a coating of abrasive material simultaneously performs a rotary motion and an axial reciprocating motion and furthermore an oscillation superimposed on the two motions.

BACKGROUND OF THE INVENTION

An apparatus of this type is known from an article entitled "Frequenz-Honen für hohe Abtragraten" [Frequency Honing to Attain High Rates of Removal] in the magazine *Werkstatt und Betrieb* [Shop and Factory] 118, 1985 (7), pp. 393 to 395 (in particular see p. 394, item 4.1). In the apparatus disclosed, an oscillating relative motion is superimposed on the basic motion of the honing operation, consisting of a rotary motion and an axial reciprocating motion. By means of this motion, an increase in the cutting speed (during the forward stroke) and automatic sharpening of the honing stones (during the backward stroke) is achieved. The oscillation is generated by two hydraulic cylinders. Although more precise information is not available from the article, it can be concluded from this article that the third motion component is a motion with a frequency of at most some 100 Hz. In this case the honing stones are hydromechanically pressed on under constant pressure.

A method called "resonant honing" is known from U.S. Pat. No. 2,939,250, which operates with a honing tool the honing bars of which are covered with a coating of abrasive material and are displaceable in a radial direction in that their oblique feed surfaces cooperate with correspondingly oblique feed surfaces of a feed bar. The feed bar is subjected to an oscillating electromagnetic field by means of a coil surrounding it which, as a result of a magnetostriction leads to corresponding periodic shortening or lengthening of the feed bar. Corresponding radial back-and-forth motions of the honing bars via the recited adjustment mechanism are a result of this oscillation. A second exemplary embodiment described in the same reference generates an oscillation between the inner surface of the bore and the stones of the abrasive material coating of the tool by setting the platform on which the workpiece has been fastened into rapid up and down motions. For this purpose the platform has been provided with an oscillation-generating device having a coil excited by an electromagnetic oscillation. In both variants of U.S. Pat. No. 2,939,250, this oscillation is intended to result in the break-down of abrasive grains which have become dull, and thus in an automatic sharpening of the abrasive coating. No information as to frequency is provided; based on the mechanical arrangement, however, it can be assumed that in this case, too, it lies somewhere around 100 Hz. The adjustment device (FIG. 2) or the platform with the workpiece (FIG. 3) illustrated would be too sluggish for higher frequencies.

A method, also with the aim of continuous automatic sharpening of the abrasive coating, is described in U.S. Pat. No. 2,939,251, where the workpiece (see FIG. 2) or the tool (see FIG. 9) is given a third oscillation which lies in the range of 20000 to 100000 Hz, preferably above the audible range, to prevent annoying surrounding noise. In this case, too, there are electromagnetically excited oscillations which are generated by means of coils moving the support for the tool or the workpiece appropriately back and forth. However, the support for the tool or the workpiece does not undergo self-oscillation, it only acts as a rigid means for the transfer of oscillations from the oscillation generator to the tool or the workpiece.

In the course of so-called super-finishing (also: outside honing) in continuous operation, the rotational-symmetrical workpieces are given a rotational motion and on the exterior surface a honing stone is placed, which is given a high-frequency oscillating motion parallel to the rotational axis of the workpiece (see German Patent Publication DE 35 33 082 A1). As a rule the oscillations used in this case have frequencies of up to 3000 oscillations per minute, i.e. of up to 50 Hz. For improving the abrasion of the workpiece it was attempted by means of the method according to the cited reference to proceed in steps and to let the super-finishing stone spark out between the individual steps, each time after a forced feed path.

In connection with super-finishing, i.e. machining the exterior surfaces of rotation-symmetrical workpieces, it has also already been attempted to use ultrasonic waves for cleaning the honing stones (see German Published, Examined Patent Application DE-AS 24 35 848). In this case, however, the ultrasonic oscillation is not forced on the tool, instead it is sprayed via a rinsing liquid as the medium into the surface between the tool and the workpiece in order to increase the removal and flushing of dull or broken-off abrasive grains.

So-called "ultrasonic eroding" does not relate technologically to machining of the interior surfaces of bores, but to drilling of bores in general by means of ultrasonic-generating machining heads. This method has already been combined with drills (see U.S. Pat. Nos. 3,614,484 and 4,828,052). By means of this method it was possible to drill bores into materials which are too hard for normal drilling. However, this does not pertain to finishing of the interior surfaces of already drilled bores.

SUMMARY OF THE INVENTION

It is an object of the present invention to improve the previously recited method further, namely on the one hand for attaining an increased removal of material and, on the other, to make possible improved correction of the shape.

This object is attained in accordance with the present invention in that an inherent-frequency oscillation of the tool in the range of from 16 to 40 kHz is generated by means of ultrasonics and that the free length of the tool beginning at the clamping place of the oscillation generator is a whole number multiple of half the wavelength of the inherent-frequency oscillation of the tool.

Not only an increased removal of material in comparison with the prior art was surprisingly shown with the present invention, but also the possibility of improved shape corrections of the bore. Furthermore, a "novel" surface is created, which is charactreized by a plurality of small pockets. These pockets (see FIG. 10) are used for receiving lubricants. This is of particularly great importance in the course of attaining an otherwise extreme exactitude and quality of shape of the surface to assure lubrication in cooperation with other components, particularly for example when the interior surfaces of the cylinder bores of automobile engines or control bores of valves are involved. Thus, in principle a novel surface and a method for its production is being disclosed.

The novel method makes possible particularly high machining allowances at comparatively small grain sizes with fine machining surfaces. Present limits in quality of conventional honing are exceeded by the achievable surface qualities. Up-to-now, values around 0.6 $\mu$m $R_z$ were considered to be the limit for hardened steel. This surface quality was clearly improved by means of the method according to the present invention. High-frequency honing in accordance with the present invention results in relatively slight machining forces. The result of this is an extremely limited burr formation. A novel surface structure with a particularly high support portion is created. A periodic surface pattern is created in accordance with kinematics, having regular "troughs" or "pockets" which are particularly suited to receive lubricants, as already mentioned.

An exemplary embodiment of the invention and of its advantageous further developments will be described in detail below, making reference to the attached drawings.

BRIEF DESCRIPTION OF THE DRAWINGS

FIG. 6 shows a first exemplary embodiment of a honing tool of the apparatus for executing the method in accordance with the present invention;

FIG. 7 shows the contour of the abrasive material coating 40 in the tool 1 in accordance with FIG. 6;

FIG. 8 shows a second exemplary embodiment of a honing tool of the apparatus for executing the method aspect in accordance with the present invention;

DETAILED DESCRIPTION OF THE PREFERRED EMBODIMENTS

Figure 1:
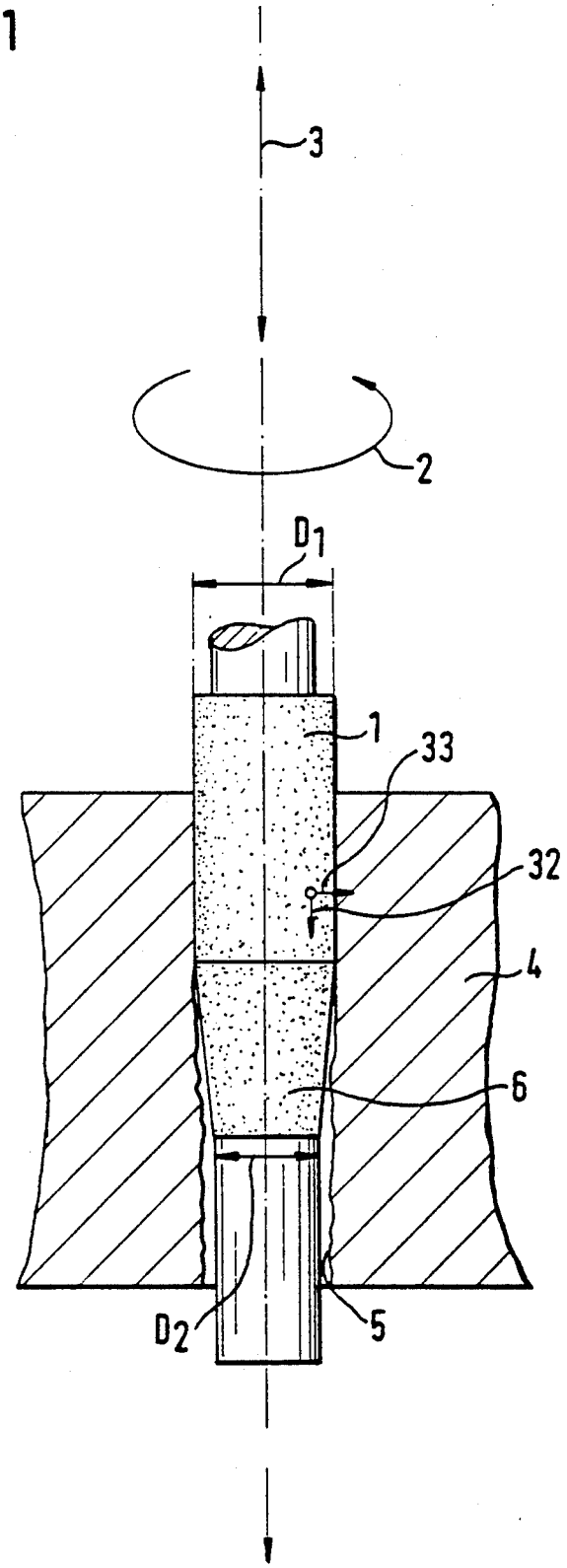
FIG. 1 is a schematic illustration of a tool in a bore for the purpose of explanation.

FIG. 1 shows a honing tool 1. The customary honing motion, which results in the cross-grinding pattern, is the sum of a rotary motion (in accordance with arrow 2) and a periodic back-and-forth motion (stroke or reciprocating motion). In accordance with the present invention a third motion, namely a short-stroke ultrasonic oscillation of the took, is superimposed on these two motion components, which leads to self-oscillation of the tool in the inherent resonance range. Excitation by means of an oscillation generator takes place in an axial direction, i.e. parallel to the stroke motion 3. This inherent resonance oscillation of the tool leads to elastic deformations of the tool and thus to motions of the individual areas of the tool in an axial as well as in a radial direction, as indicated by arrows 32 and 33. In an exemplary embodiment the oscillation takes place at a frequency of 21.7 kHz of an amplitude, which could be adjusted to maximally 15 $\mu$m.

The workpiece 4 has a bore 5, the interior surface of which is intended to be machined. As known per se, the honing tool 1 is embodied as a mandrel honing tool and provided with a conical cutting zone 6, the greatest rear diameter $D_1$ of which is somewhat greater than the smallest diameter of the bore 5 not yet machined by the honing tool 1. The smaller front diameter $D_2$ permits the introduction of the tool 1. At the stroke in the direction of the arrow the conical cutting zone 6 enters the bore 5 and removes that material which corresponds to a bore diameter of less than $D_1$. The honing tool 1 is cylindrically embodied behind the conical cutting zone 6, so that it is inserted into the bore. Machining preferably takes place with an axial double stroke.

The unexpected effect, that very much more material can be removed and that in this way it is possible to remove defects in the shape of the bore to a greater extent than previously possible, is the result of the additional excitation of the honing tool 1 by means of a high-frequency short-stroke ultrasonic oscillation in the axial direction. Furthermore, a novel type of surface is generated, which is characterized by a plurality of small, pocket-shaped depressions. This surface is illustrated by a photograph in FIG. 10.

Figure 2:
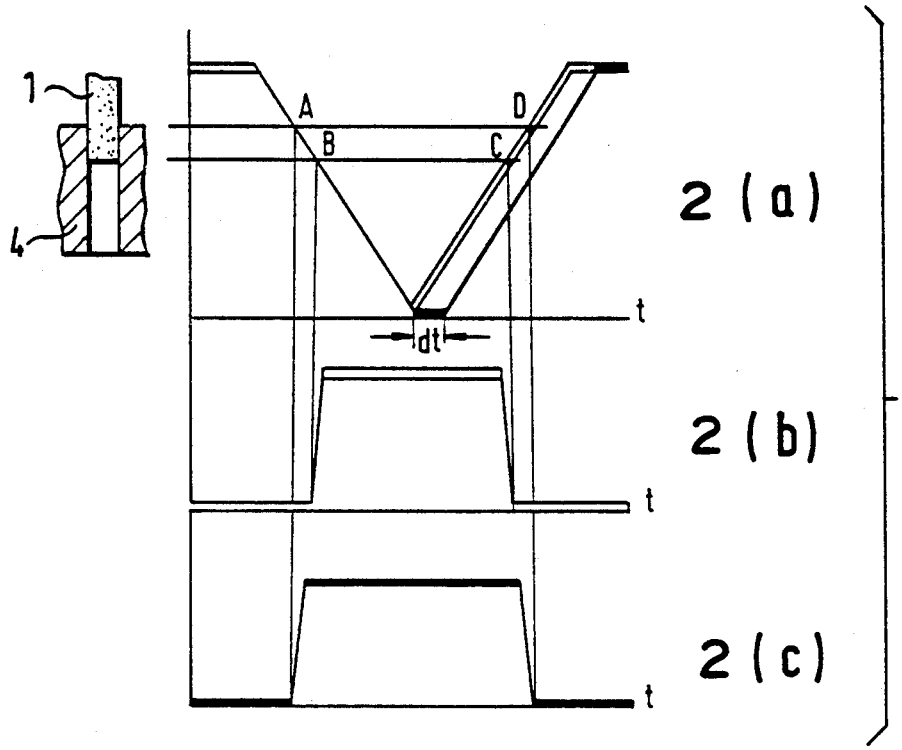
FIG. 2 is a control schematic for machining a bore in accordance with the method aspect of the present invention.
Figure 3:
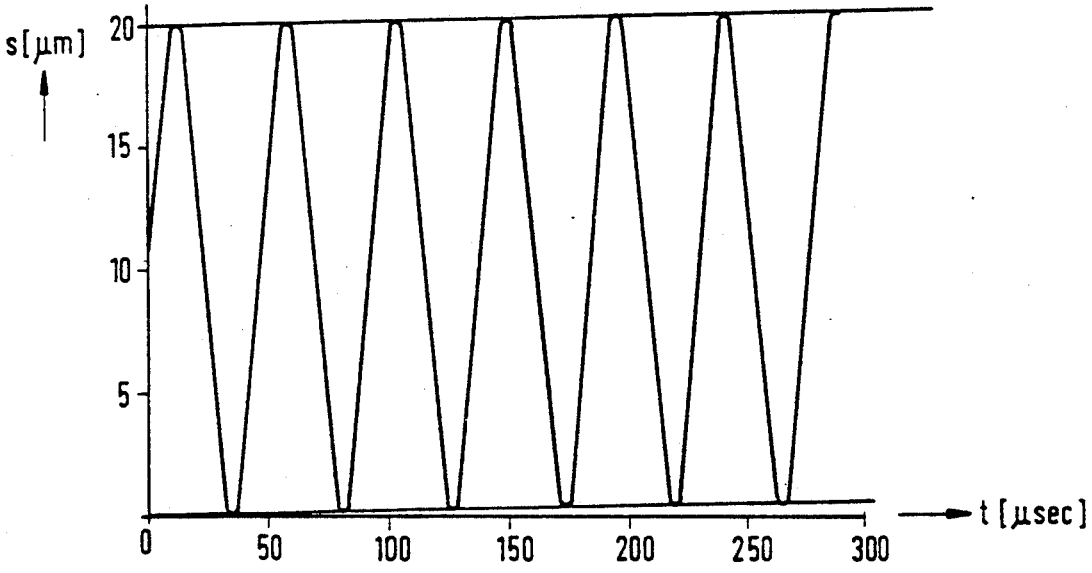
FIG. 3 shows the oscillatory path of a grain of abrasive material at the wall of the bore.

FIG. 2 shows a control diagram of the stroke motion 3 at 2(*a*), of the rotation motion 2 at 2(*b*) and of the ultrasonic excitation at 2(*c*) in their relationship in time to each other and as a function of time. The broader line at 2(*c*) indicates the amplitude of the ultrasonic oscillation. The dwell time dt at 2(*a*) can be set. In the same way the points A, B, C, D can be set, i.e. in each case the beginning and start of the rotational motion and the high-frequency oscillatino. In a test, a machine for executing the method aspect in accordance with the present invention, taking into consideration the control diagram according to FIG. 2, was designed with the following data:

Length of stroke: 400 mm

Stroke drive: 0.4 kW
Stroke speed: less than 650 mm/min
Rotary drive: 0.4 kW
Rpm: less than 5000 l/revs.
Dwell time at the bore bottom: less than 10 s
Amplitude: 15 μm max.
Frequency: 20–24 kHz
Sound output of the generator: up to 2.4 kW The path of movement of the tip of an abrasive material grain 7 as a function of time in a range from 0 to 300 μsec is shown in FIG. 2. The upper and the lower limit lines, each of which represent a rising path, correspond to the oblique path of the striae during conventional honing.

Figure 4:
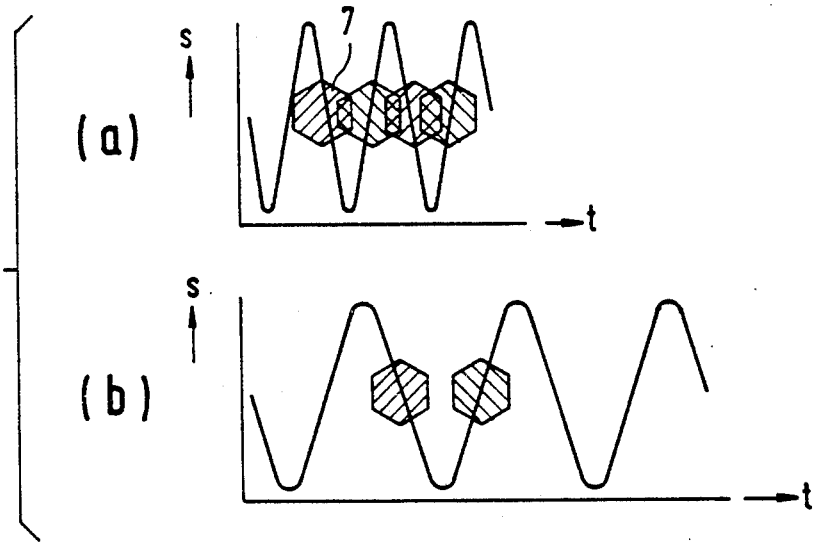
FIG. 4 is a schematic view intended to explain the overlapping of the grains.

If it is imagined that the individual grains of abrasive material 7 rest with a particular surface on the surface to be machined along this high-frequency oscillation path, one of the two situations shown in FIG. 4 is the result, depending on how the duration of one oscillation (oscillation period) and its amplitude are adapted to the peripheral speed of the honing tool 1. At (a), i.e. with a relatively "narrow" oscillation in relation to the bearing surface of the grains of abrasive material 7, the result is that a grain of abrasive material 7 covers a particular surface during the first ultrasound stroke, which is again partially covered during the next ultrasonic stroke taking place in the opposite direction. This means that the same surface is practically repeatedly machined, depending on the selection of these parameters, so that there is a "spark out" effect. By means of a different selection of these parameters, such as at 4(*b*), it is possible to limit this effect to the areas in the vicinity of the oscillation peaks. In general, a selection of parameters resulting in a path according to 4(*a*) is more advantageous.

FIG. 6 shows the apparatus for executing the method.

Figure 5:
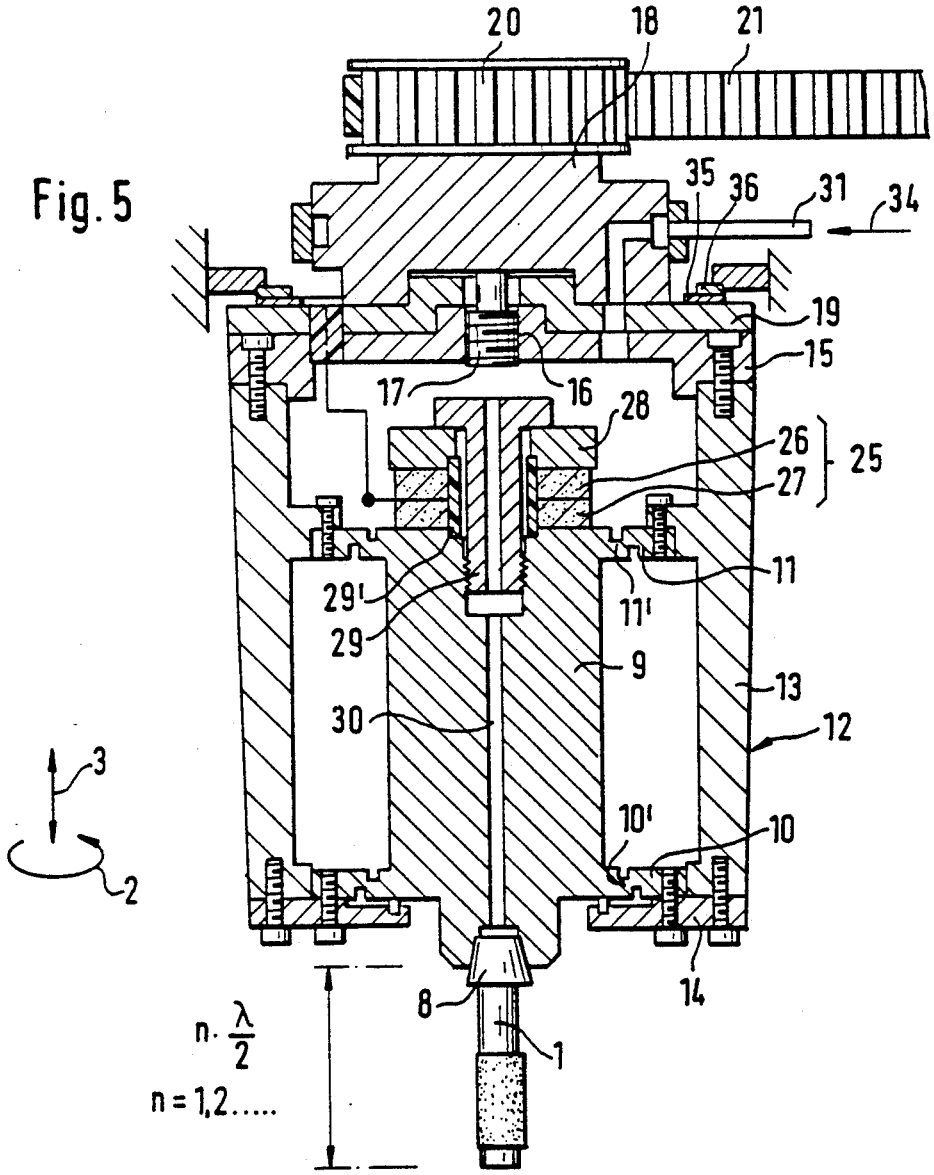
FIG. 5 shows the apparatus for executing the method in accordance with the present invention.

The honing tool 1, ground to the contour measurements $D_1$ and $D_2$, is received with its tool receiving cone 8 in a conical receptacle opening 8' of a sound transmission body 9. The sound transmission body 9 has two flanges 10, 11, which are provided at points 10', 11' with grooves in the stepped manner illustrated, so that thin regions 10', 11' are created, which have the effect of a hinged suspension, and an axial, high-frequency oscillation made by the sound transmission body 9 is not transmitted to the housing 12. The sound transmission body 9 is made of titanium, for example. The housing 12 consists of a cylindrical part 13, a lower cover 14 and an upper cover 15. In its center, the upper cover 15 has a bore 16 provided with an inner thread, into which the threaded tang 17 extends. Thus the housing cover 15 and the receiving hub 18 are fixedly threaded together, with the disk 19 being clamped between them. In this way the housing 12 turns along with the receiving hub 18, which is driven via a toothed belt wheel 20 and a toothed belt 21 in the rotational direction. The entire unit as shown in FIG. 5, including a motor (not shown), is upwardly and downwardly displaceable for generating the stroke motion, such as is known from conventional honing machines. Accordingly, a more detailed description of the structural details can be omitted in the present instance.

The actual ultrasonic oscillation generator 25, formed in the exemplary embodiment by two piezo-electrical elements (quartz crystals) 26 and 27, is seated on the top of the sound transmission body 9. For tuning the oscillating system, a disk 28, representing an oscillating weight, is disposed above the ultrasonic oscillation generator 25. The entire arrangement is firmly clamped by means of the clamping bolt 29, which is threaded into the sound transmission body 9. Centering takes place by means of a centering sleeve 29'. A coolant conduit 30 extends through the sound transmission body 9 and the clamping bolt 29. A cooling medium can be supplied to the interior of the housing through a conduit 31 and the openings in the disk 19 and the cover 15.

The supply of electrical energy for the ultrasonic oscillation generator 25 takes place in the manner illustrated by means of collector rings 35 disposed in the cover 15 and by collector rings 36 disposed on the part of the unit which does not turn along with it. FIG. 6 shows the simplest form of a honing tool 1 in the form of a fixed mandrel with fixed, non- adjustable exterior dimensions. The abrasive coating 40 in this case has the contour, as shown in detail in FIG. 7, namely an insertion zone 37 over a little less than 10% of its length, following that, the already mentioned cutting zone 6 extending over a little less than half of the entire length of the abrasive material coating, and following that the cylindrical guide zone 38.

In the present case the customary radial expansion known for adjusting honing tools presents certain difficulties, because there is the danger that individual parts, which are displaceable with respect to each other and are not located in an oscillation node, rub against each other under the influence of the high frequency, so that excessive heat can be generated. It must also be assured that no parts can come loose in spite of the high-frequency oscillation. In this regard specially constructed honing tools are advantageous. Such a honing tool 100 is illustrated in FIG. 8. In this case the abrasive coating 40, having a contour in accordance with FIG. 8, is disposed on a shaft 101 which can be elastically expanded by means of an expansion part 102. This is the case, for example, if the cutout 103 in the shaft 101, on the one hand, and the expansion element 102, on the other, are conically embodied, so that the result during axial displacement of the expansion element is an elastic expansion of the shaft in the radial direction. However, the shaft is embodied as a solid piece without grooves and without slits so as to assure particular stability. The required elastic radial expansions can also be achieved in this manner. A pressure element 104, exchangeably seated in the cutout 103, follows the expansion element 102 in an axial direction. With its right end it rests against the pressure face 105 of the receiving element 106 which, in turn, is seated with the right end in the tool receiving cone 8 of the sound transmission body 9. It is therefore possible to expand the abrasive coating 40 elastically by inserting pressure elements 104 of different length. The longer the pressure element 104, the greater the radial expansion of the shaft 101.

The tool 1 performs self-oscillation, preferably in the resonance range. By this is meant that the tool 1 does not act as a transmission element, rigid per se, for the high-frequency ultrasonic oscillation, but is itself a medium of the ultrasonic oscillation, i.e. of the longitudinal and transverse waves triggered by the excitation. As already mentioned above, this means that the tool 1 itself performs oscillations in the axial and radial direction with the inherent (resonance) frequency excited by the ultrasonic oscillation, and periodically changes its contour in the course of this. To achieve advantageous coupling of the ultrasonic energy from the ultrasonic oscillation generator 25 with the tool 1, the ultrasonic oscillation generator 25 must have a frequency which is as equal as possible to the self-resonance of the tool 1. If the self-resonance of the tool differs too widely from that of the exciting system (oscillation generator 25, sound transmission body 3), the device does not oscillate. To make the transmission of the ultrasound energy from the oscillation generator 25 to the tool 1 optimal, the sound wave resistance of the oscillation generator must be as equal as possible to that of the tool.

Figures 9A, 9B, 9C:
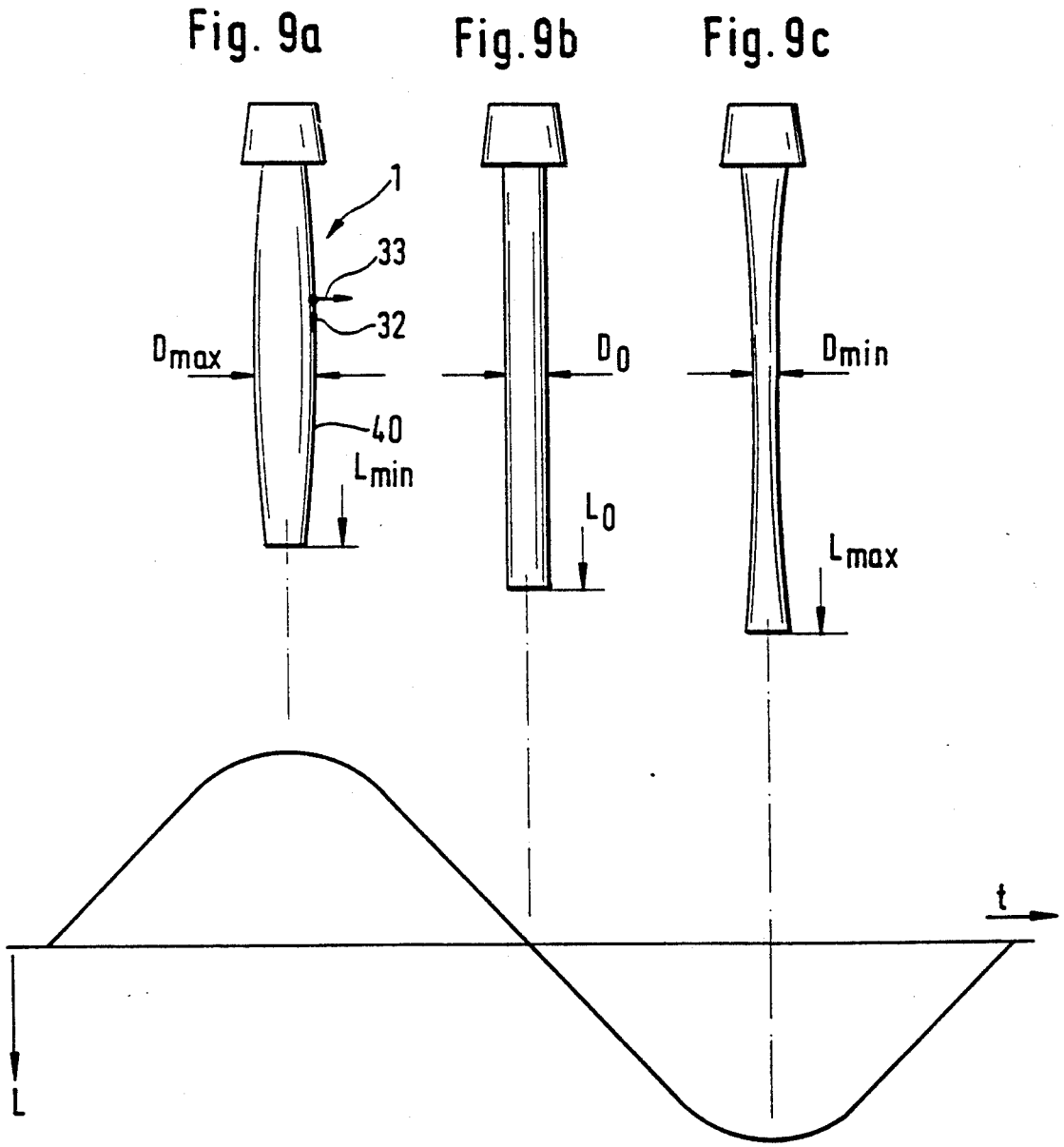
FIGS. 9(*a*)–9(*c*) are schematic illustrations of the elastic deformation of the contour and the length of the tool in the course of performing self-oscillation.

The inherent frequency of the tool 1 is determined by the dimensions (length, diameter), the E-modulus of the material and the speed of sound particular to the material. With steel, the E-modulus is approximately 21,000 daN/mm$^3$ and the speed of sound 5,960 m/sec. At 21.7 kHz this results in a wavelength equal to 187 cm. This is the free length of the tool starting at the clamping cone. How the self-oscillation of the tool 1 looks geometrically is illustrated in FIG. 9. In this case the diameter of the tool has its greatest value $D_{max}$ at 9(*a*), while the length L has the least value, $L_{min}$. The mean diameter $D_0$ and the mean length $L_0$ are shown at 9(*b*), the zero passage of the oscillation in the longitudinal direction. The minimum diameter $D_{min}$ and the maximum length $L_{max}$ are shown at 9(*c*). The individual amplitudes are associated with the situations according to FIGS. 9(*a*), 9(*b*) and 9(*c*).

As indicated in FIG. 9(*a*), a motion component 32 in the axial direction as well as a motion component 33 in the radial direction is indeed obtained for each grain of the abrasive material coating 40. Both components are subject to the inherent frequency.

The motion component 33 in the radial direction is the cause for individual small pockets being cut in the radial direction of the machined bores during the rotation of an abrasive material grain of the abrasive material coating 40.

Figure 10:
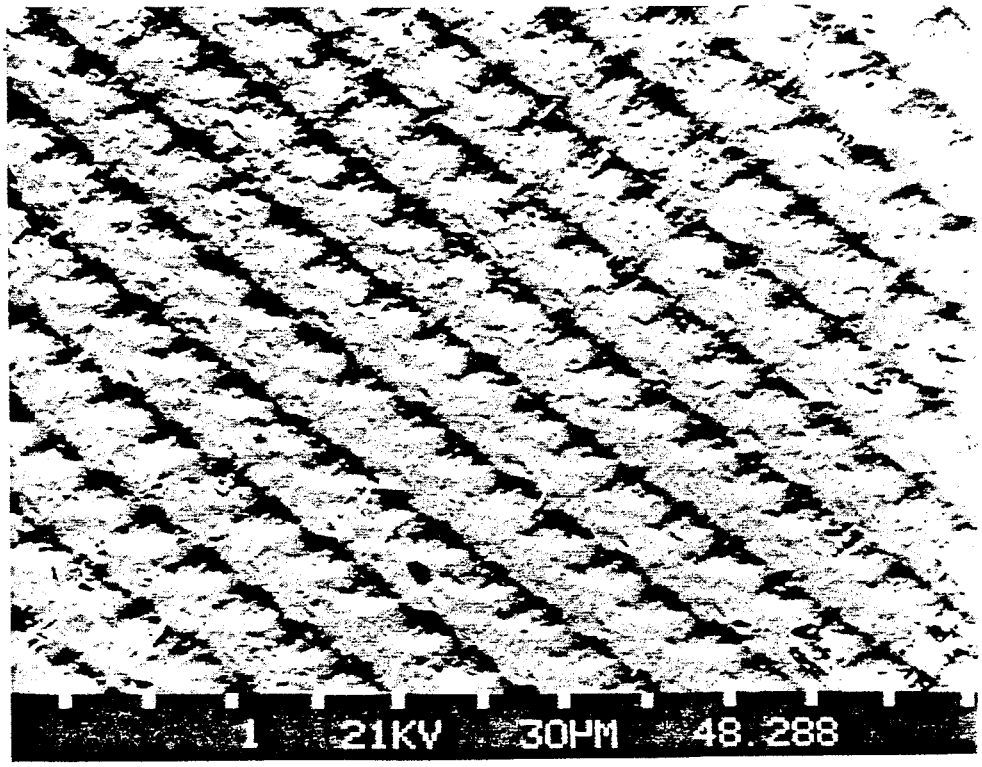
FIG. 10 is a micro photograph of the surface of a bore machined in accordance with the method aspect of the present invention.

FIG. 10 shows this novel surface in the form of a micro pohtograph—since it cannot be shown otherwise. To clarify the scale, a distance equal in reality to 30 μm has been drawn into the micro photograph. It has now surprisingly been shown that, because of the superimposed high-frequency oscillation, with radial and axial components, troughs or pockets are generated at short distances from each other along the oblique striae of the cross-grinding pattern resulting from the classical honing, which during the rotation are practically "hammered in" or "chiseled in". As can be clearly seen in the micro photograph, level, supporting areas free of burrs are created between the troughs, which can support other component. The pockets or troughs are used as oil reservoirs for lubricants in the inner surfaces of the bores. This is of particular great importance if otherwise a surface of extremely good quality has been attained. The material is evenly removed and a periodic surface pattern corresponding to the kinematics is created. Of course this is very much dependent on the set parameters. At low rpm, for example, the cutting traces generated by the high-frequency oscillation lie close in respect to each other. At high rpm these cutting traces are correspondingly extended and result in a somewhat less advantageous support portion. In a test series, the support portion was approximately 30% at a cutting depth of approximately 0.2 μm.

The novel surface results in an extreme improvement of the support properties. If, for example, a particular bore is worked in two machining stages with grain sizes D46 and D15 (in accordance with the FEPA definition; see VDI Guidelines VDI 3394 of June 1980), values below 0.5 μm can be attained with respect to the bore geometry (straightness, roundness). This was done experimentally with workpieces which had been prehoned conventionally to a diameter of 6.955 to 6.965 mm and were finished in two further machining steps in accordance with the method of the present invention. At the beginning the surface roughness was 0.7 μm $R_z$ and was improved to less than 0.4 μm $R_z$ with an increasing number of pieces. Diamond was used as the grain in this case.

In general, super-abrasive materials are under consideration, thus cubic bort nitride (CBN), besides diamond, and possibly ruby, sapphire or corundum for bores in soft material (for example aluminum).

The machining forces occurring are of particular importance for the use of the method aspect of the present invention. With an allowance of 10 μm (the difference between the diameter of the unworked bore and the final measurement intended to be achieved by machining) and with the use of the fixed mandrel and the grain size D46, an axial force of 1.0N and a torque of 1.120 Ncm was detected. A direct comparison with machining where the same tool would have geen used without high-frequency charging was not possible, since it was impossible to achieve an allowance of more than 4 μm without the high-frequency oscillation. If it is desired to remove more material by means of a stroke without HF-oscillation, the tool seizes. But even with an allowance of 4 μm without high-frequency oscillation, i.e. with an allowance reduced by more than 50%, the axial force still was 2.4N and the torque 1.3 Ncm. Thus it can be assumed that by means of the method aspect of the present invention it is possible to remove 2 to 3 times the allowance in a double stroke, and that in this case the axial force and the torque are still less than in the conventional method.

It also follows from this that only slight burr formation is caused by the method here described. In workpieces which had been machined in tests no burr formation at all could be noted, as can be clearly seen from FIG. 10.

Figure 11:
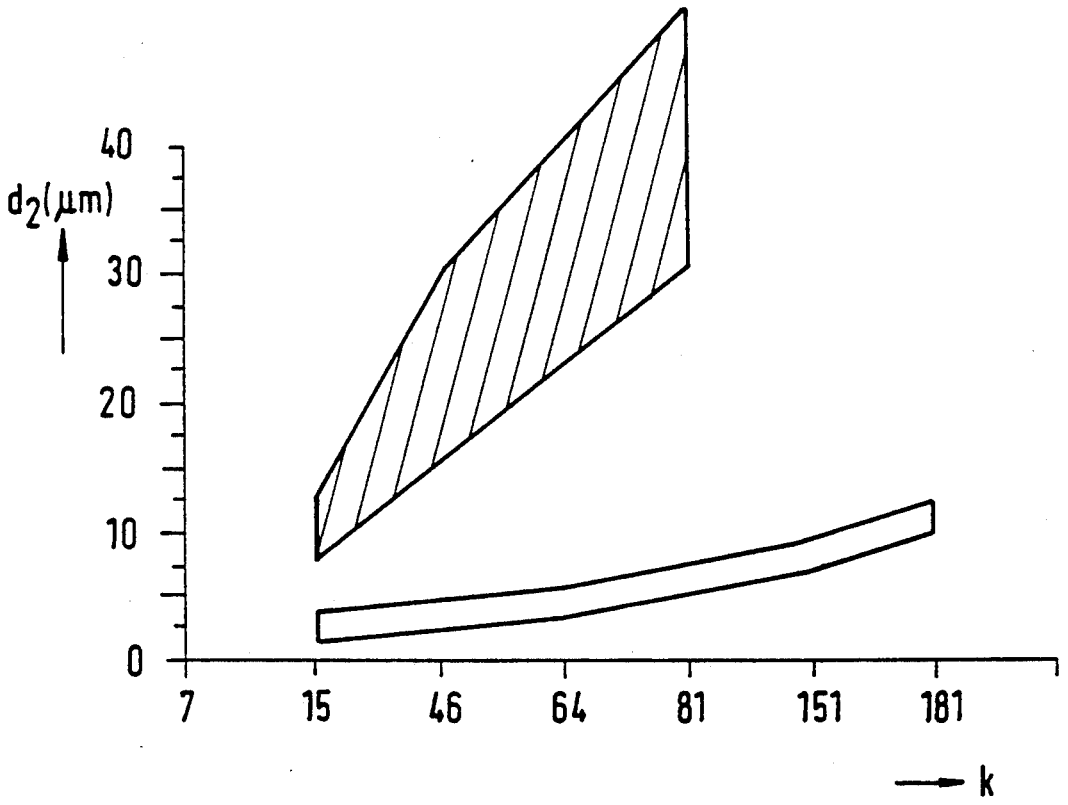
FIG. 11 is a schematic for explaining the honing allowances attainable with the method aspect of the present invention.

Finally, FIG. 11 shows the hone allowance $d_2$ (in micrometers) as a function of the grain size k (in accordance with the FEPA definition) in a comparison between the known honing mandrels (the lower bar slowly rising from a grain size D15 to D181) and high-frequency honing (filled in area). The workpiece is of hardened steel of a hardness of more than 60 HRc.

Figure 12:
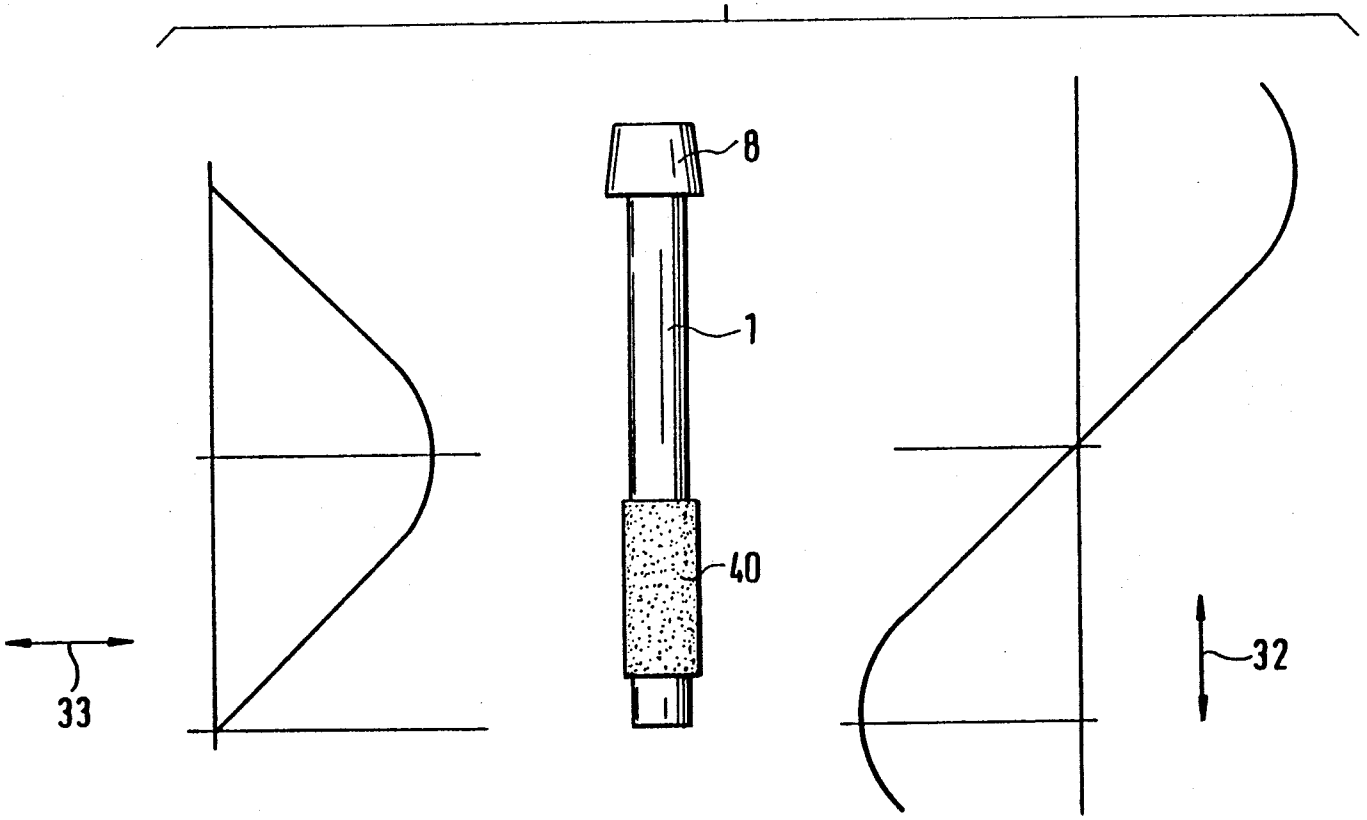
FIG. 12 is an illustration of the assignment of the shape of the tool 8 to the position of the radial oscillation and the oscillation in the longitudinal direction of the self-oscillation.

The oscillation conditions over the length of the tool 1 can be seen from FIG. 12 for the case where the length of the tool 1 is equal to half the wavelength of the ultrasonic oscillation. Generally, the prerequisite for the appearance of self-oscillation is that the length of the tool 1, starting at the clamping cone lying in the "captive plane", is a whole number multiple (incl. times 1) of half the wavelength. In this case the oscillation in the radial direction, the component 33, has been entered left of the tool, and on the right the oscillation in the axial direction, the component 32 and brought into relationship with the length of the tool 1.

Figures 13A, 13B, 13C:
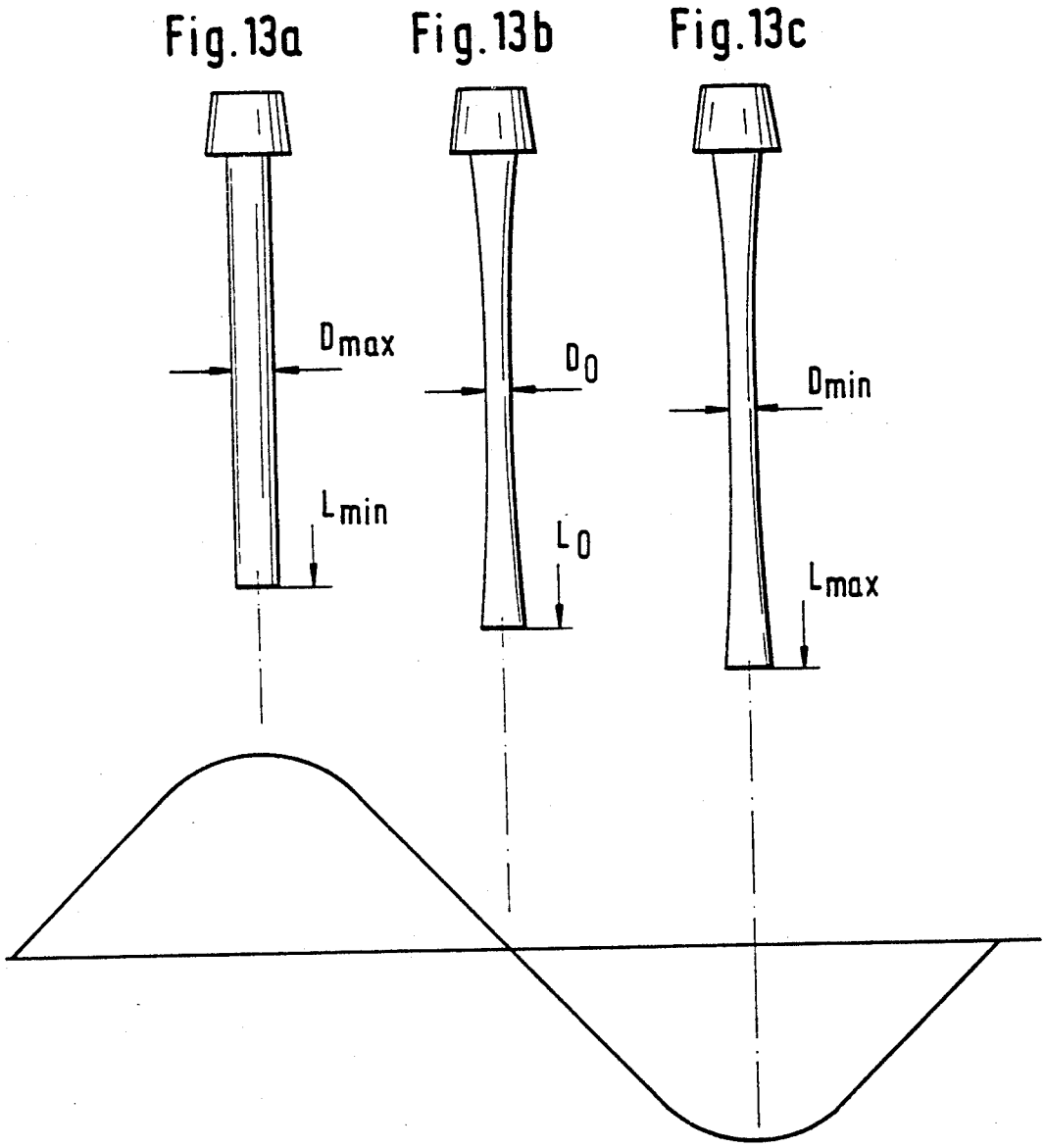
FIGS. 13(*a*)–13(*c*) are a variant of FIGS. 9(*a*)–9(*c*) in such a way that a cylindrical shape of the tool is created with the maximum amplitude of the radial component of the inherent-frequency oscillation of the tool of the apparatus.

A particularly advantageous embodiment of the present invention can be seen in FIG. 13. This illustration essentially corresponds to FIG. 9, but with the difference that the shape of the tool in the position of rest (zero passage 13(*b*)) has not been provided cylindrically, but with a convex contour. It follows from this that in the state of the greatest expansion following 13(*a*), i.e. at $D_{max}$ and $L_{min}$ a cylindrical shape of the tool will result.

The allowance of the diameter depends on the input amplitude. Thus, with a change of the amplitude of the ultrasonic oscillation, by which the self-oscillation of the tool 1 is excited, the amplitude of the axial oscillation component 33 and also $D_{max}$ can be set. The quality of the machined bore is also directly affected by these parameters. The depth of roughness $R_z$ decreases as an essentially linear function of amplitude and frequency.

Figure 14:
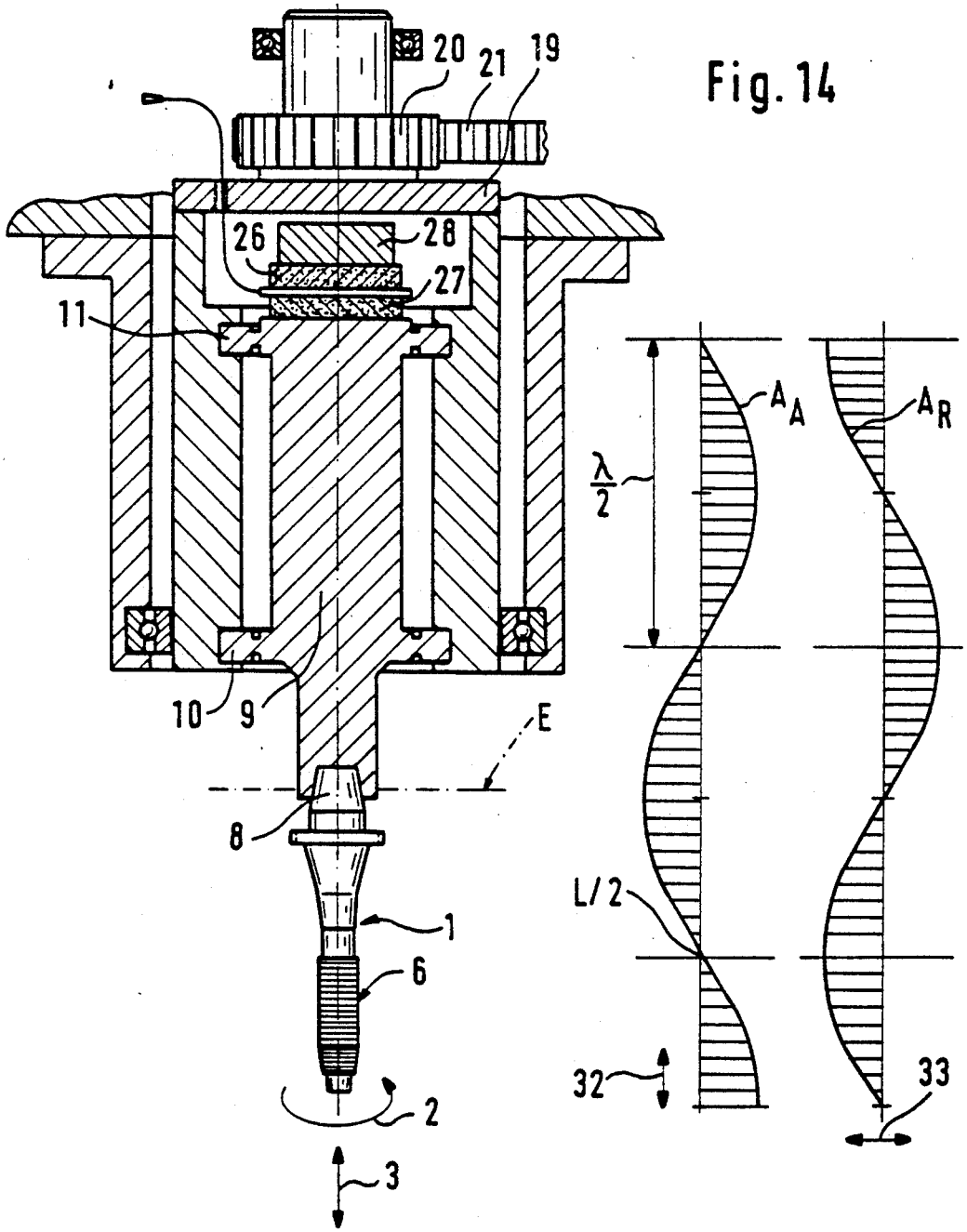
FIG. 14 is a further embodiment showing a tool received in a tool receiving device, similar to the device as shown in FIG. 5.

FIG. 14 combines, practically, for purposes of giving additional information, what already has been shown in FIGS. 5 and 12. The oscillation components of the inherent oscillating of tool 1 in the axial direction (arrow 32) and in the radial direction (arrow 33) are related not only to the tool 1 and its cutting zone 6 respectively, which is coated with abrasive material, but also to the tool receiving apparatus. The amplitude of the oscillation component in the axial direction is depicted with $A_A$, the amplitude of the oscillation component in the radial direction by $A_R$. It is shown that for achieving inherent (also: resonant or "eigengrequent") oscillation of the tool, the length of the sound transmission body 9 between its flanges 10, 11 should be equal to one half wavelength (lambda/2) or an integral multiple thereof. The tool 1 is clamped with its receiving cone 8 at the sound transmission body 9 essentially at plane E. Plane E is positioned such tat the axial oscillation component amplitude $A_A$ has a maximum when intersecting this plane, whilst the radial oscillation component amplitude $A_R$ is zero at this plane E and at the free end of the tool. The abrasive coating of cutting zone 6 extends over the lower half of honing tool 1, i.e. between the point indicated by L/2 (length of the tool/2) and the free end thereof.

Figure 15:
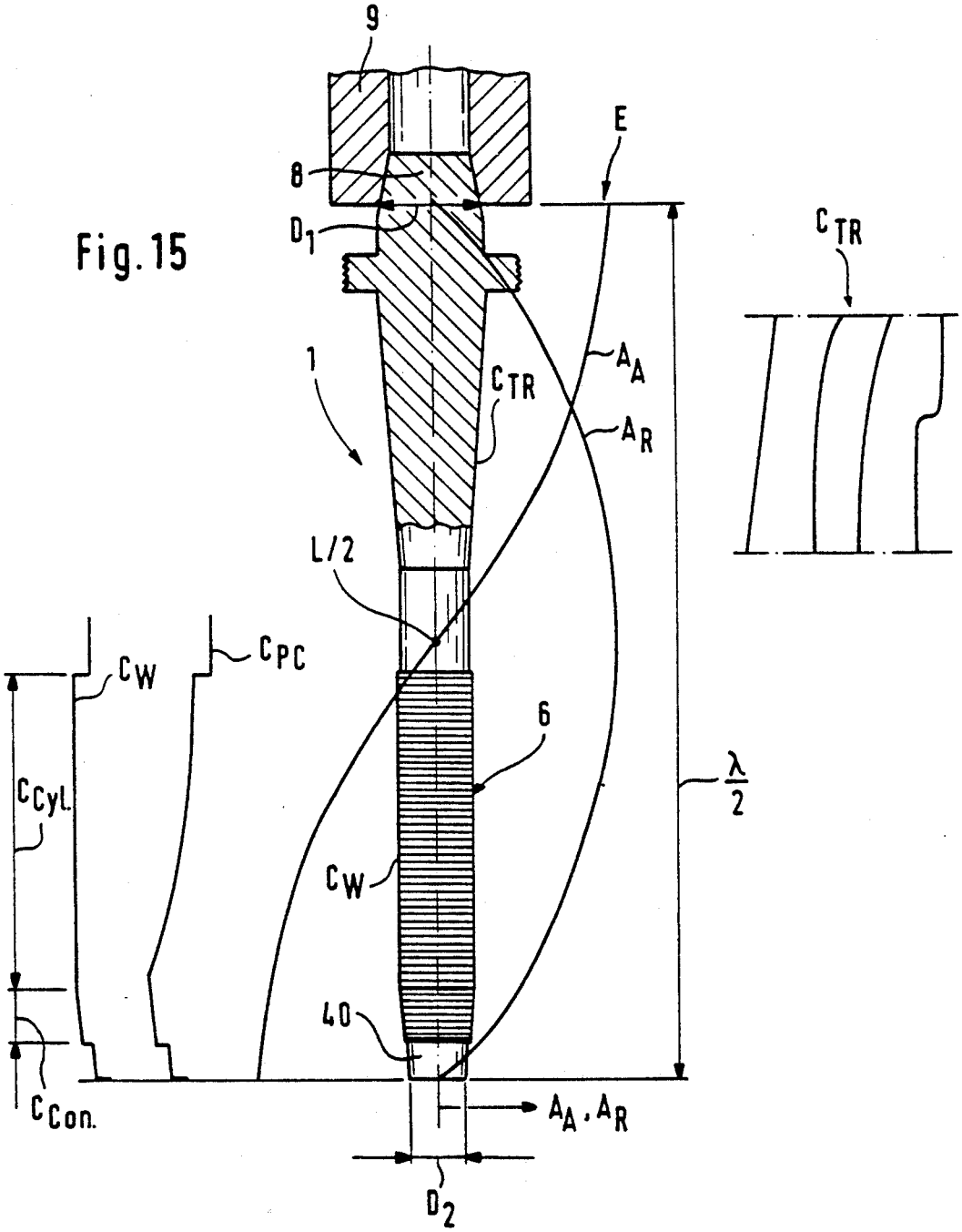
FIG. 15 is an enlarged view of the tool as shown in FIG. 14.

FIG. 15 shows the same tool as FIG. 14, however in an enlarged scale and with some more details in order to demonstrate how the shaping of the contour can and should be adjusted to obtain optimum performance. The abrasive coating area of cutting zone 6, in its working condition, i.e. when energized by the above mentioned ultrasonic oscillation, should be exactly $C_W$, this working contour $C_W$ including a relatively long cylindrical section $C_{Cyl}$ and a comparatively short conical section $C_{Con}$. This type of working contour has the effect, that the tool, when introduced in a bore, the untreated diameter of which is somewhat less than the diameter of the cylindrical section $C_{Cyl}$ of the tool, first contacts the bore with the conical section $C_{Con}$ and thereafter with the cylindrical section $C_{Cyl}$. The actual abrasive and honing work, during one forward and one rearward stroke, is mainly provided by the transitional section $C_{TR}$ between the cylindrical section $C_{Cyl}$ and the conical section $C_{Con}$.

To obtain this working contour $C_W$ in its operating condition, the contour in the inoperative condition, i.e. in which the tool is produced, must take into account that it will undergo a certain change as a consequence of the superposition of the amplitude $A_R$ of the oscillation component in the radial direction. The latter one has to be added to the contour of the tool 1 in the inoperative condition to obtain the working contour $C_W$ of the tool 1. To obtain this contour $C_W$ in the operative condition, in the inoperative condition of the tool a contour of the cutting zone 6, as identified by $C_{PC}$, must be provided at the inoperative tool, i.e. when it is at rest. This contour $C_{PC}$ is shown in FIG. 15 on the left side of honing tool 1. It can be seen that, beginning at point L/2, the contour $C_{PC}$ increases somewhat in the radially outward direction until it reaches the end of the cylindrical section $C_{Cyl}$ and therefrom it decreases in the radial direction, this decrease, however, being somewhat steeper than the corresponding decrease of the working contour $C_W$. The changes in diameter of the tool within cutting zone 6 lie within the range of approximately 6–9 μm. Half of this value roughly corresponds to the maximum of the amplitude $A_R$ of the radial oscillation component.

Further, when dimensioning the tool, the transformation ratio must be considered, i.e. the change of the oscillation amplitude as it will be observed between the clamping plane E and the free end of the tool as resulting from the sinusoidal form of the oscillation amplitude and further from the tool geometry. Between plane E, at which the tool 1 has the diameter $D_1$, and the portion of the tool 1, at which it is coated with abrasive material, there appears a certain transition contour $C_{TR}$. A variety of possible transition contours $C_{TR}$ are shown on the right side of FIG. 15.

As mentioned, the transformation ratio also varies with the geometry and thus with the relation of the diameter $D_1$ in plane E to the diameter $D_2$ at the free end of tool 1. The larger this ratio, the larger also is the transformation ratio. This also is a reason why one would like to have a diameter $D_1$ as large as possible.

Figure 16:
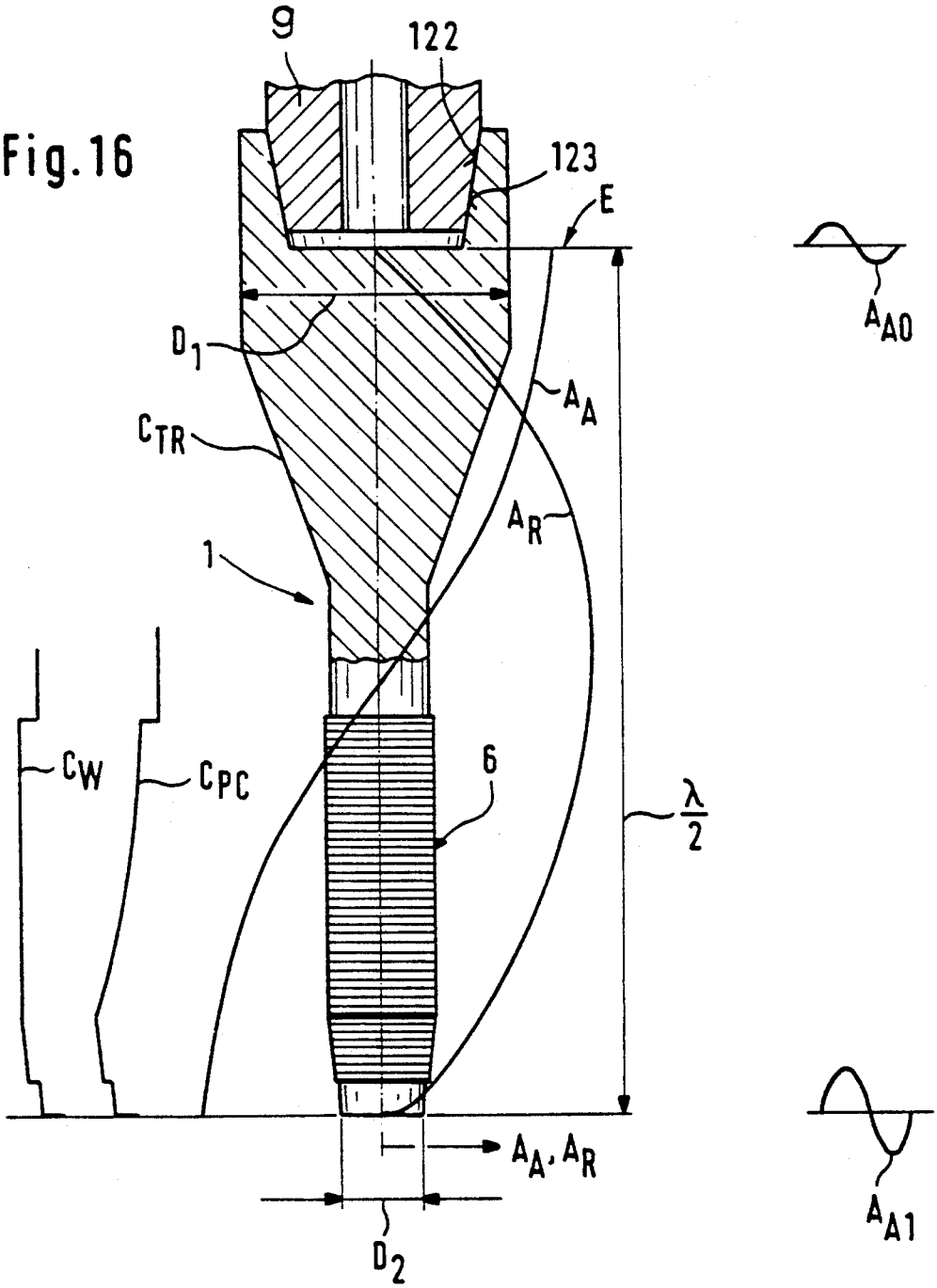
FIG. 16 is a further embodiment of a tool in accordance to the invention.

A honing tool constructed in accordance with these principles is shown in FIG. 16. It differs from the tool in accordance to FIG. 15 in that the reception on the tool at the end of the sound transmission body 9 is made by an interior cone 122 provided at the tool 1, whilst correspondingly the end of the sound transmission body 9 is provided with an exterior cone 123. The amplitude $A_{A0}$ of the axial oscillation component at plane E and the amplitude $A_{A1}$ at the free end are shown at the corresponding positions. The shown geometric configuration even results in an amplitude amplification from the plane E to the free end of the tool, i.e. the ratio $A_{A1}$: $A_{A0}$, is greater than 1.

Figure 17:
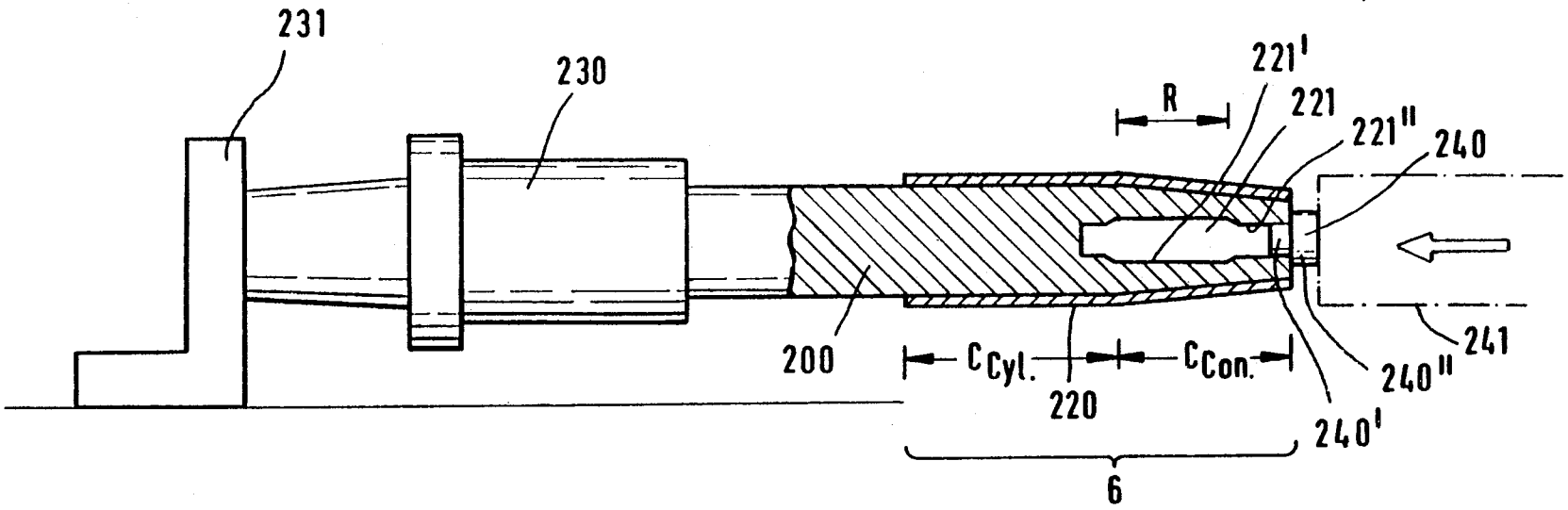
FIG. 17 is a still further embodiment of a tool in accordance with the invention.

FIG. 17 shows a honing tool 200, provided with an abrasive coating 220 extending over the cutting zone 6. When the abrasive coating 220 will be worn off, the adjustment to account for the wear and to reestablish the original desired contour CW will be made by plastic deformation of the tool. To this end, the honing tool 200 is provided with a barrel-shaped interior bore 221 coinciding axially with the range R of largest expected wearoff; it practically includes the transition zone between the conical section $C_{Con}$ and the cylindrical section $C_{Cyl}$. The location of the range R essentially corresponds to the enlarged portion 221' of bore 221.

To provide for a readjustment of the contour after wear, the honing tool 200 is inserted into a clamping cone 230 at a holding support 231. Then a pressure member 240 is inserted in the forward opening 221" of bore 221. To this pressure member 240 pressure will be applied by means of a hydraulic device 241 shown in dash-dotted lines. With its forward mandrel-shaped end 240', the pressure member 240 extends into the forward opening 221" of bore 221. Adjacent to its forward end 240', the pressure member 240 is provided with a stepped cylindrical portion 240". The diameter of this cylindrical portion 240", however, does not cover the whole forward end face of the tool 200, but is rather just broad enough to guarantee a transfer of the exerted pressure into the honing tool 200. This construction effects an introduction of forces into the honing tool 200 such that shearing tensions are generated within the tool, which result in a plastic deformation in the radial direction.

As an alternative means of providing for a compensation of the wear of the coating it also is possible to increase the input amplitude $A_{40}$ (see FIG. 1) with all other parameters remaining the same this results in an increase of the amplitude of the radial oscillation component within range R.

A further possibility of compensating the wear of the cutting coating is the change of the stroke speed, i.e. the speed with which the forward and backward motion of tool 1 in the direction of arrow 3 takes place. It can be shown that with a slow stroke speed relatively larger volumes can be cut off than this with high speeds. The reasons for this might be that with a slow motion the cutting coating can better free itself from abraded material.

What is claimed is:

1. A honing tool for honing a workpiece having an interior bore, the tool being used in shaping the interior bore of the workpiece by means of an abrasive coating, and when rotated and reciprocated in an axial direction simultaneously, and when further energized by an ultrasonic resonant motion, the honing tool having an operative condition and an inoperative condition, and comprising:

a shaft with a free length equal to a half wavelength of the ultrasonic motion or an integer multiple thereof; and means for introducing the ultrasonic motion onto said honing tool at one end of said honing tool, said one end being adapted to be received in a sound transmission body, wherein:

said shaft having a free end and an abrasive coating, said abrasive coating having a contour, which, when viewed from the free end of said honing tool and in the operative condition of said honing tool when energized with the ultrasonic motion, includes a relative short conical section and adjacent thereto a relatively long cylindrical section, the contour of the honing tool in the inoperative condition being determined such that in the operative condition it is obtained by superposition of an amplitude of a radial oscillation component of the ultrasonic motion and the contour of the honing tool in the inoperative condition.

2. The honing tool as defined in claim 1, wherein the contour in the operative condition increases radially from a point at a half length of said honing tool over a section in the free end direction, which in the operative condition is cylindrical, and adjacently decreases in diameter more than the diameter of said honing tool in the operating condition.

3. The honing tool as defined in claim 2, wherein the diameter of said honing tool increase is approximately 6 to 9 μm.

4. The honing tool as defined in claim 1, wherein said abrasive coating extends from the free end of said honing tool over a quarter of a wavelength of said ultrasonic motion.

5. The honing tool as defined in claim 4, wherein between the plane within which said honing tool is adapted to be clamped to a receiving device, and the point at which the abrasive coating begins, a transition contour of decreasing diameter is provided.

6. The honing tool as defined in claim 5, wherein said transition contour is determined such that a ratio of the amplitude of an axial oscillation component at the plane of receiving said honing tool and an amplitude at the free end of said honing tool results in an amplification factor greater than 1.

7. The honing tool as defined in claim 1, wherein one end of said honing tool adapted to be received in a receiving device is provided with an interior cone.

8. The honing tool as defined in claim 1, wherein said honing tool further is provided with a flange.

9. The honing tool as defined in claim 1, wherein the tool is provided with a barrel shaped interior bore, which extends axially in coincidence with the area of largest wear of the tool.

10. The honing tool as defined in claim 1, wherein said shaft is elastically expandable at its free end.

11. The honing tool is defined in claim 10, further comprising:

an expansion element; and a pressure element, wherein:

said shaft has a longitudinally extending bore having a conical section at its free end for the reception therein of said expansion element, followed by reception of said pressure element such that said expansion element and said pressure element are axially aligned.

* * * * *